US006441722B2

(12) United States Patent
Weiner

(10) Patent No.: US 6,441,722 B2
(45) Date of Patent: Aug. 27, 2002

(54) CONTAINER CAP MEDICATION REMINDER

(76) Inventor: Steven L. Weiner, 1850 Mt. Diablo Blvd., #620, Walnut Creek, CA (US) 94596

( * ) Notice: Subject to any disclaimer, the term of this patent is extended or adjusted under 35 U.S.C. 154(b) by 0 days.

(21) Appl. No.: 09/801,071

(22) Filed: Mar. 6, 2001

Related U.S. Application Data

(60) Provisional application No. 60/187,197, filed on Mar. 6, 2000.

(51) Int. Cl.[7] ..... G08B 1/00

(52) U.S. Cl. ..... 340/309.15; 340/309.4; 340/825.17; 368/10; 368/107; 368/109; 368/278

(58) Field of Search ..... 340/309.15, 309.4, 340/825.17; 368/10, 107, 109, 278

(56) References Cited

U.S. PATENT DOCUMENTS 5,233,571 A * 8/1993 Wirtschafter ..... 368/10
5,625,334 A * 4/1997 Compton ..... 340/309.15
5,751,661 A * 5/1998 Walters ..... 368/10
5,815,586 A * 9/1998 Dobbins ..... 381/124
6,084,504 A * 7/2000 Rosche et al. ..... 340/309.15

* cited by examiner

*Primary Examiner*—Jeffery Hofsass
*Assistant Examiner*—Hung Nguyen
(74) *Attorney, Agent, or Firm*—Richard Esty Peterson Patent Attorney

(57) ABSTRACT

A medication container having a removable cap with an electronic reminder unit in the cap, the reminder unit having a operational control allowing a health care provider to set a clock and a medication schedule having one or more medication times with an alarm signal generated at the medication times, the reminder unit having a user shut-off and an automatic shut-off for terminating the alarm signal, wherein upon a shut-off the reminder unit generates an alarm signal at the next medication time.

2 Claims, No Drawings

CONTAINER CAP MEDICATION REMINDER

This application claims the benefit of provisional application for Container Cap Medication Reminder, Ser. No. 60/187,197 filed Mar. 6, 2000.

SUMMARY OF THE INVENTION

The sequence of operation that is set forth herein is one preferred sequence for the electronic alarm device in the cap of the medication bottle described in my U.S. patent application filed Sep. 28, 1999, Ser. No. 09/407,006, entitled "MEDICATION REMINDER DEVICE".

Bottle Cap Operation

Pharmacist sets time of day.

Pharmacist sets the number of doses (1, 2, 3 or 4).

After successfully completing the time and dose settings, the cap beeps and lights three (3) times to confirm the cap is working properly.

Consumer can set the cap for three (3) types of alerts:

1. Light only (default)
2. Light and Beep
3. Light and Vibrate

Consumer takes the first dose and pushes the light/button. This action sets the caps' programmed timer to alert the consumer the next time a dose is due to be taken.

When the internal clock senses 12:00 a.m. (Midnight), all interval timing stops. No more reminders for the day occur. At 4 a.m. The light starts blinking to remind the consumer (when they wake) that the first dose of the day needs to be taken. When the consumer takes the first dose and resets the light/button, the pre-programmed intervals begin for the day.

If the consumer does not take the first dose by 8 a.m., the beeper starts as an additional reminder. The beeper and light continue to signal until 10 a.m. If the consumer does not reset, indicating the first dose was taken, the indicators stop and the next dose reminder will start at the appropriate programmed time.

One (1) Dose/Day

Consumer takes a dose and pushes the light/button. This sets the next dose alert to go off in 24 hours. If, after the first day (pharmacy pick up day), the consumer wishes to take the dose each morning, the consumer merely presses the light/button two (2) times consecutively the next morning. This action resets the time interval so the next alert will be 24 hours later (or the next morning). A similar procedure can be done if the dose is taken each morning. ps Two (2). Three (3), Four (4) Doses/Day When the second dose of the day is due, the light/button starts blinking (1 blink indicating 1 dose taken). Consumer has the option to set the cap to beep or vibrate as additional alerts. Consumer pushes the light/button and takes medication. If the second dose is not taken within 1 hour, the cap continues to blink and, in addition, the beeper beeps every 30 seconds for an additional hour. If the light/button is not reset, indicating the dose was taken, after the 2nd hour, all indicators stop and the next dose alert will start at the appropriate pre-programmed time. Light will indicate next pre-programmed dose by blinking (2 blinks when 3rd dose due indicating 2 doses taken). Similar sequences occur for the 3rd and 4th doses.

What is claimed is:

1. In a medication container having a container cap with an electronic reminder device in the cap a method of signaling an alarm comprising the steps of, providing a clock means for determining the time of day, providing a clock setting means for setting the clock means to the correct time of day, providing an alarm setting means associated with the clock means having means for selecting one of a plurality of predetermined multiple alarm intervals during a day, providing an alarm means associated with the alarm setting means for signaling an alarm at a pre-set start time during the day, providing an alarm termination means wherein an alarm terminated by a user activates the next interval for the next alarm wherein the alarm means signals an alarm for a predetermined time before automatically ceasing and activating the interval for the next alarm and wherein at a second pre-set time late at night, all interval timing stops until activated at the pre-set start time during the day.

2. The electronic reminder device of claim 1 wherein the alarm means includes multiple alarm signals and the user selects at least one of the multiple alarm signals.

* * * * *